US007770405B1

(12) United States Patent
Dillon

(10) Patent No.: US 7,770,405 B1
(45) Date of Patent: Aug. 10, 2010

(54) ENVIRONMENTAL AIR CONTROL SYSTEM

(75) Inventor: Robert J. Dillon, Brooklyn Center, MN (US)

(73) Assignee: AC DC, LLC, Minnetonka, MN (US)

( * ) Notice: Subject to any disclaimer, the term of this patent is extended or adjusted under 35 U.S.C. 154(b) by 1025 days.

(21) Appl. No.: 11/329,397

(22) Filed: Jan. 10, 2006

Related U.S. Application Data

(60) Provisional application No. 60/643,048, filed on Jan. 11, 2005.

(51) Int. Cl.
*F25B 49/00* (2006.01)
*F25D 17/04* (2006.01)
*F25D 17/06* (2006.01)
*G05D 22/02* (2006.01)

(52) U.S. Cl. ..... 62/176.5; 62/176.6; 62/93; 236/44 C

(58) Field of Classification Search ..... 62/173, 62/175, 176.1, 176.6, 176.5, 92, 93; 236/44 C
See application file for complete search history.

(56) References Cited

U.S. PATENT DOCUMENTS 3,139,735 A 7/1964 Malkoff et al.
3,264,840 A 8/1966 Harnish
3,798,920 A 3/1974 Morgan
4,502,292 A 3/1985 Ares et al.
4,711,094 A 12/1987 Ares et al.
4,938,032 A 7/1990 Mudford
5,065,586 A 11/1991 Shapiro-Baruch
5,088,295 A 2/1992 Shapiro-Baruch
5,267,450 A 12/1993 Takegawa et al.
5,305,822 A 4/1994 Kogetsu et al.
5,345,776 A 9/1994 Komazaki et al.
5,598,887 A * 2/1997 Ikeda et al. ..... 165/202
5,622,057 A 4/1997 Bussjager et al.
5,678,417 A 10/1997 Nigo et al.
5,689,962 A 11/1997 Rafalovich
5,706,664 A 1/1998 Hara
5,752,389 A 5/1998 Harper
5,826,443 A 10/1998 Ares et al.
6,212,892 B1 4/2001 Rafalovich
6,247,323 B1 6/2001 Maeda
6,347,527 B1 2/2002 Bailey et al.
6,622,500 B1 * 9/2003 Archibald et al. ..... 62/173
6,705,093 B1 * 3/2004 Taras et al. ..... 62/90
6,826,921 B1 12/2004 Uselton
7,028,492 B2 * 4/2006 Taras et al. ..... 62/159

* cited by examiner

*Primary Examiner*—Chen-Wen Jiang

(57) ABSTRACT

An air control apparatus having a refrigerant compressor, a condenser, an evaporator coil, and a reheat coil associated with a four way valve to selectively regulate flow of refrigerant to and from the condenser, evaporator coil and reheat coil to control the temperature and humidity of an enclosed environment.

4 Claims, 7 Drawing Sheets

AIR CONDITIONING MODE

HEAT PUMP MODE

DEHUMIDIFIER MODE

ENVIRONMENTAL AIR CONTROL SYSTEM

CROSS REFERENCE TO RELATED APPLICATION

This application claims the priority benefit of U.S. Application Ser. No. 60/643,048 filed Jan. 11, 2005.

FIELD OF THE INVENTION

The invention relates to heating, air conditioning and dehumidification of air supplied to an interior enclosure. Air conditioning and heat pump equipment is used with reheat coils and refrigerant control valves to dehumidify air.

BACKGROUND OF THE INVENTION

Comfort is a relative term that is different for virtually every individual because of sex, age, ethnicity, and activity level. Comfort is tied not only to the temperature but also to the relative humidity of an environment. Scientists have also found that a humidity level between 30 and 50 percent discourages many types of mold, dust mites, allergens, and certain bacteria.

There have been air conditioning and heating systems designed to remove humidity from the air. Many of these depended on reheating the cooled air either by use of additional heat from the oil or gas furnace or electric heat, both of which are cost prohibitive. Other approaches have included multiple evaporators and condensers but these were often difficult to control and required complex controls both for the temperature and the storage of refrigerant. A more common method of removing humidity is by adding a separate dehumidifier to the system which is often cost prohibitive plus duplicates the refrigeration system in the air conditioner or heat pump.

There have also been attempts to reduce humidity by extending the cooling cycle after the thermostat has reached the preset cooling temperature. This is normally in conjunction with a reduction in the fan speed of the air handler motor. The reduction in fan air volume reduces the heating effect of the air passing over the evaporator which in turn lowers the temperature of the evaporator. The temperature reduction will be lowered to below the dew point temperature of the air and moisture from the air will condense on the coil thus reducing the humidity level of the space. The current designs typically allow the temperature to be reduced below the set point of the thermostat by a preset amount thus cooling the space below that was desired. When the final temperature is reached, the unit will shut off and will not restart until cooling is called for. If the temperature inside the structure stays below the set point of the thermostat cooling is not called for and the humidity level can rise above the comfort level. This is the "clammy" or damp feeling often encountered in the Spring and Fall of the year space is often described as feeling "clammy".

Requirements by the United States government have dictated that the efficiency of air conditioning equipment and heat pumps must meet or exceed a Seasonal Energy Efficiency Rating (SEER) of 13 by January, 2006. Many of the manufacturers of air conditioning equipment have achieved this goal by increasing the size of both the evaporator and the condenser coils. This lowers the pressure differential across the compressor which results in less power consumption per BTU (British Thermal Unit). The increased size of the evaporator has reduced the ability of the air conditioning system to remove moisture from the air resulting in higher humidity levels. There are no federal energy savings requirements for dehumidifiers.

SUMMARY OF THE INVENTION

The environmental air control system of the invention is an air conditioning or heat pump system that the owner/operator can adjust to the level of temperature and humidity desired without experiencing unnecessary cooling plus operate virtually all year round. It is a single system that does not require adding a dehumidifier whether it is an additional refrigeration based system, an enthalpy wheel or chemical dehumidification. It utilizes the full capacity of the air conditioning system to remove humidity as opposed to an add on dehumidifier which normally has a smaller BTU capacity rating. It is cost effective through the use of off the shelf components and there are no special refrigerant charge management components. It affects the entire structure and not just the basement where conventional dehumidifiers are normally found.

DESCRIPTION OF EMBODIMENTS OF INVENTION

Figure 1:
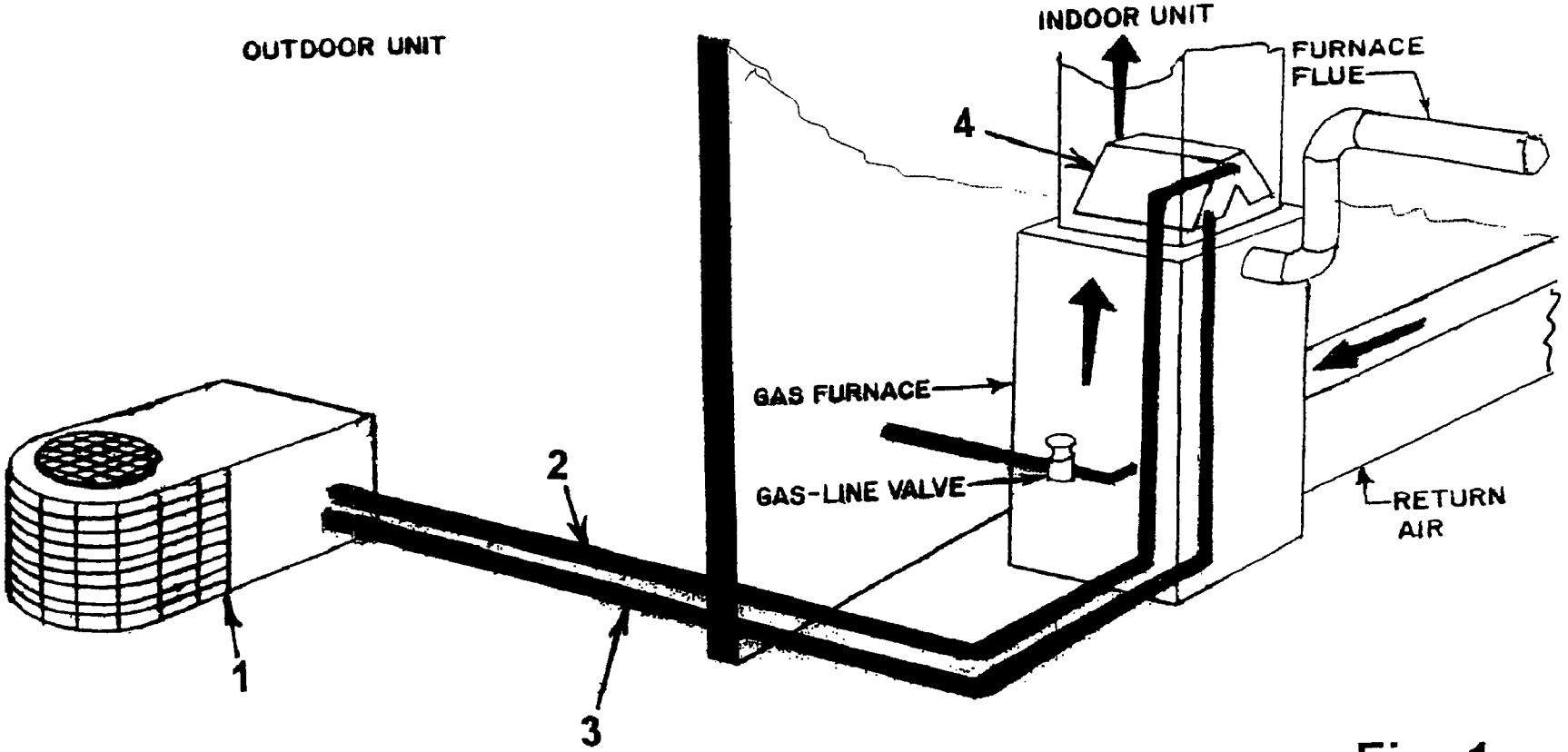
FIG. 1 is a three-dimensional drawing of a conventional residential air conditioning or heat pump system showing the normal location of the components.

FIG. 1. In the conventional air conditioning system, the outdoor condensing unit 1 consisting of a compressor, an aluminum finned copper tube condenser coil, a condenser fan to force air across the condenser, and the electrical components such as relays and capacitors needed to operate the system are placed outside the structure to be air conditioned. Copper refrigeration tubing, a liquid line 2 for transferring the condensed refrigerant to the inside evaporator or cooling coil 4 and a suction line 3 to return the evaporated refrigerant gas back to the compressor in the condensing unit. The evaporator 4 is mounted in the supply air or discharge air of the furnace. The furnace is normally natural or propane gas fuel oil or electric. It is not advisable to operate the air conditioning during the heating cycle as this may overheat the refrigerant in the evaporator and ultimately damage the compressor.

The conventional heat pump system is approximately the same the addition of a four-way valve in the outdoor condensing unit which reverses the flow of the refrigerant. When the flow is reversed, the outside coil becomes the evaporator and is warmed by the surrounding air in the structure. The air passing over the evaporator is warmed and heats the structure. The heat pump is so named for its ability of "pump" heat out of the outside air and into the house or structure.

There are instances where there is no need for heat but only air conditioning. In this case, the air is normally forced through the coil by a fan and is discharged into the space to be cooled. Air from the air conditioned space is returned to the inlet of the fan to repeat the cycle.

Figure 2:
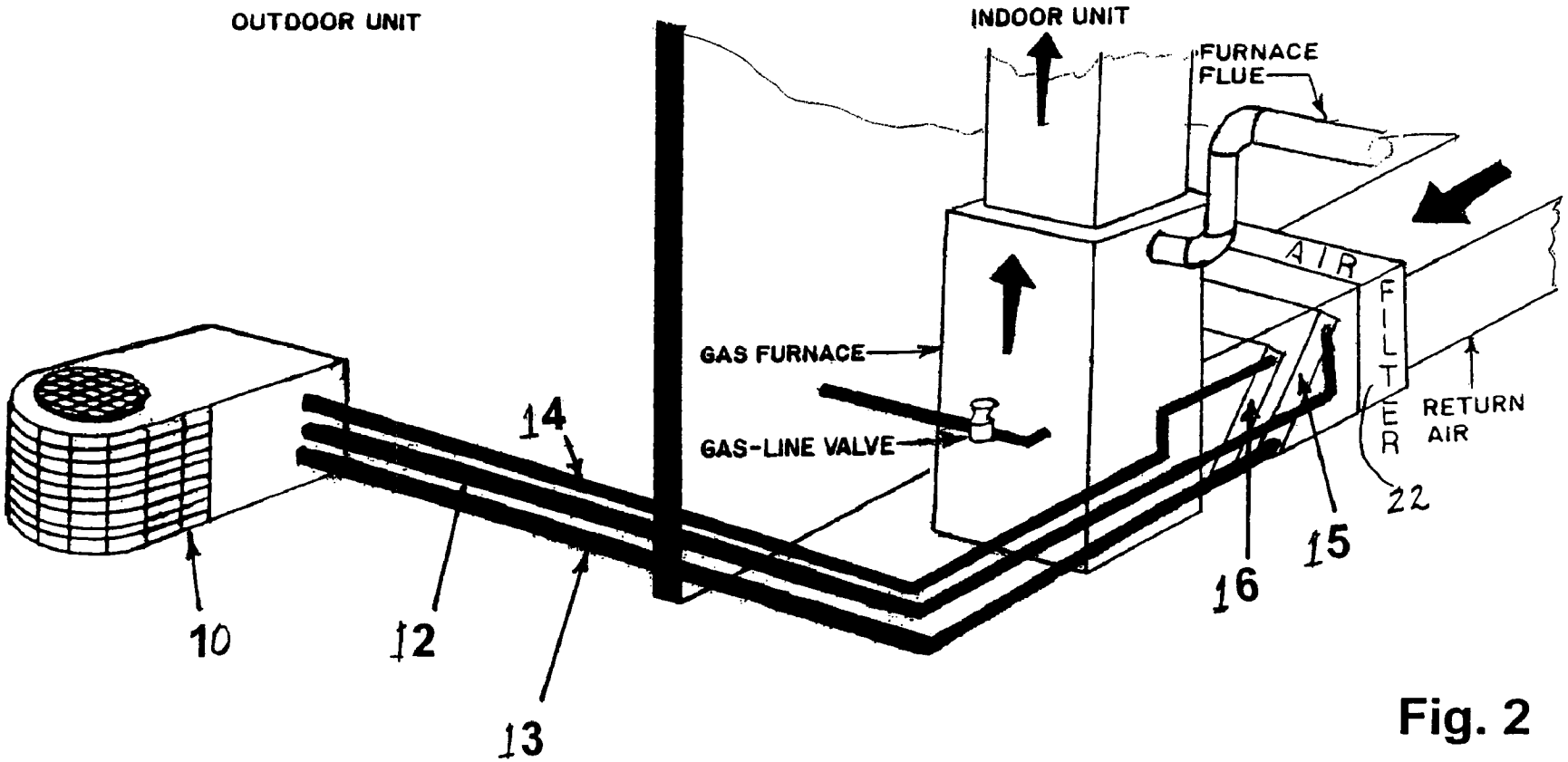
FIG. 2 is a three-dimensional drawing of the environmental air control system of the invention showing the modifications for either an air conditioning or heat pump system and the additional requirements for the installation of either type system.

FIG. 2 Air Conditioning System. The environmental air control system of the invention uses an outdoor condensing unit 10 placed outside the structure that consists of a compressor, an aluminum finned copper tube condensing coil, a condenser fan 19 to force air across the condenser 17, and a four-way valve 18 to direct the flow of the discharge refrigerant gas from the compressor 10 as well as the cool refrigerant gas returning to the inlet or suction side of the compressor 10. This unit also contains the normal electrical components for the operation of the unit.

There are three copper refrigeration tubes 12, 13, and 14 that connect the condensing unit 10 to the aluminum finned copper coils located inside the structure. Liquid tube 12 transfers the condensed liquid refrigerant from condenser 17 to the evaporator or cooling coil 15, a suction tube 13 that returns the cool suction gas refrigerant back to the compressor 10, and a reheat tube 14 that transfers hot discharge gas from the compressor 10 to the reheat coil 16 during the dehumidification mode of operation. This third copper tube 14 is also used to return the evaporating refrigerant in the reheat coil back to the suction or inlet side of the compressor when the unit switches from the dehumidification mode back to the cooling mode of operation.

In this system there are two coils 15 and 16 located in the return air of the furnace. There is the evaporator coil 15 and reheat coil 16. The return air is cooled by the evaporator coil 15 during the air conditioning mode of operation. The air is pulled across the reheat coil 16 to the fan in the furnace or air handler and this cool air is discharged through the duct system to the space to be air conditioned. During this mode of operation there is no flow of refrigerant through the reheat coil 16 so it has no effect on the temperature or humidity of the return air.

During the dehumidification mode of operation the discharge gas from the compressor passes through the reheat copper tube to the reheat coil 16. The furnace return air cools the hot refrigerant gas and it condenses into a liquid. The liquid refrigerant goes into the evaporator coil 17 where it is heated by the return air and returns to the compressor 10 through the copper suction tube 13 as a cool gas.

The dehumidification is enhanced by reducing the fan speed of the furnace fan. Since the amount of heat removed from the air by the evaporator coil 17 is counterbalanced by the heat added to the air in the reheat coil 16, there is not a significant amount of change in the temperature delivered to the space.

Since both these coils 15 and 16 are on the return air side of the furnace, not the discharge or supply side of the furnace, they are unaffected by the heat of the furnace being operated in the heating mode. This allows the system to operate the entire year. Generally, it would not be needed during those periods of time, normally the winter months, when dehumidification is not needed.

Heat Pump System. The environmental air control heat pump system uses an outside condensing unit 10 that is placed outside the structure and contains a compressor, an aluminum finned copper tube condenser coil, a fan to move outside air across the condenser, and two four-way valves to direct the flow of refrigerant to the three coils (condenser, evaporator and reheat). Evaporator 15 and reheat coil 16 are mounted in the return air side of the furnace and are not affected by the furnace heat.

When the heat pump is in the air conditioning mode of operation, the liquid refrigerant from the condenser passes through the copper liquid tube 12 to the evaporator where it changes from a liquid to cool gas and cools the air passing into the furnace. The cool gas is returned through the suction line 3 and returns to the compressor. The reheat coil 16 has no influence on the temperature of the system as there is very little gas refrigerant in it.

In the heating mode of operation, the hot discharge gas from the compressor 10 passes through the suction tube 13 and enters the outlet of the evaporator coil 15. The hot gas is condensed to the liquid state in the evaporator and heats the air passing over it. It returns to the condensing unit 10 via the liquid line 12 and passes through the flow rater piston restrictor valve 21 located on the outlet of the condenser. Valve 21 is designed to provide full flow in one direction but restricts the flow of refrigerant in the reverse direction. This restriction acts as a metering device to feed the condensed liquid refrigerant to the condenser where it absorbs heat from the outside air and returns to a gaseous state to return to the compressor. While in the heating mode there is no flow of refrigerant to the reheat coil 16 which has no effect on the temperature of the air.

When the system switches to the dehumidification mode, the hot discharge gas passes through the reheat tube 14 and enters the reheat coil 16. It is cooled by the return air to the furnace and changes from a hot gas to a warm liquid. This warm liquid goes through the thermostatic expansion valve of the evaporator coil 15 and it passes through the evaporator coil 15 it changes from a warm liquid to a cool gas. The cool gas is returned to the compressor 10 through the suction tube 13. The fan 19 is turned off in this mode.

The coils are mounted in such a way that the air passes over the evaporator coil 15 where it is cooled and then passes over the reheat coil 16 which heats the air back to the original temperature. Also, there are filters 22 mounted in the return air duct before the coils 15 and 16 to protect them from the normal accumulation of dust and dirt.

Figure 3:
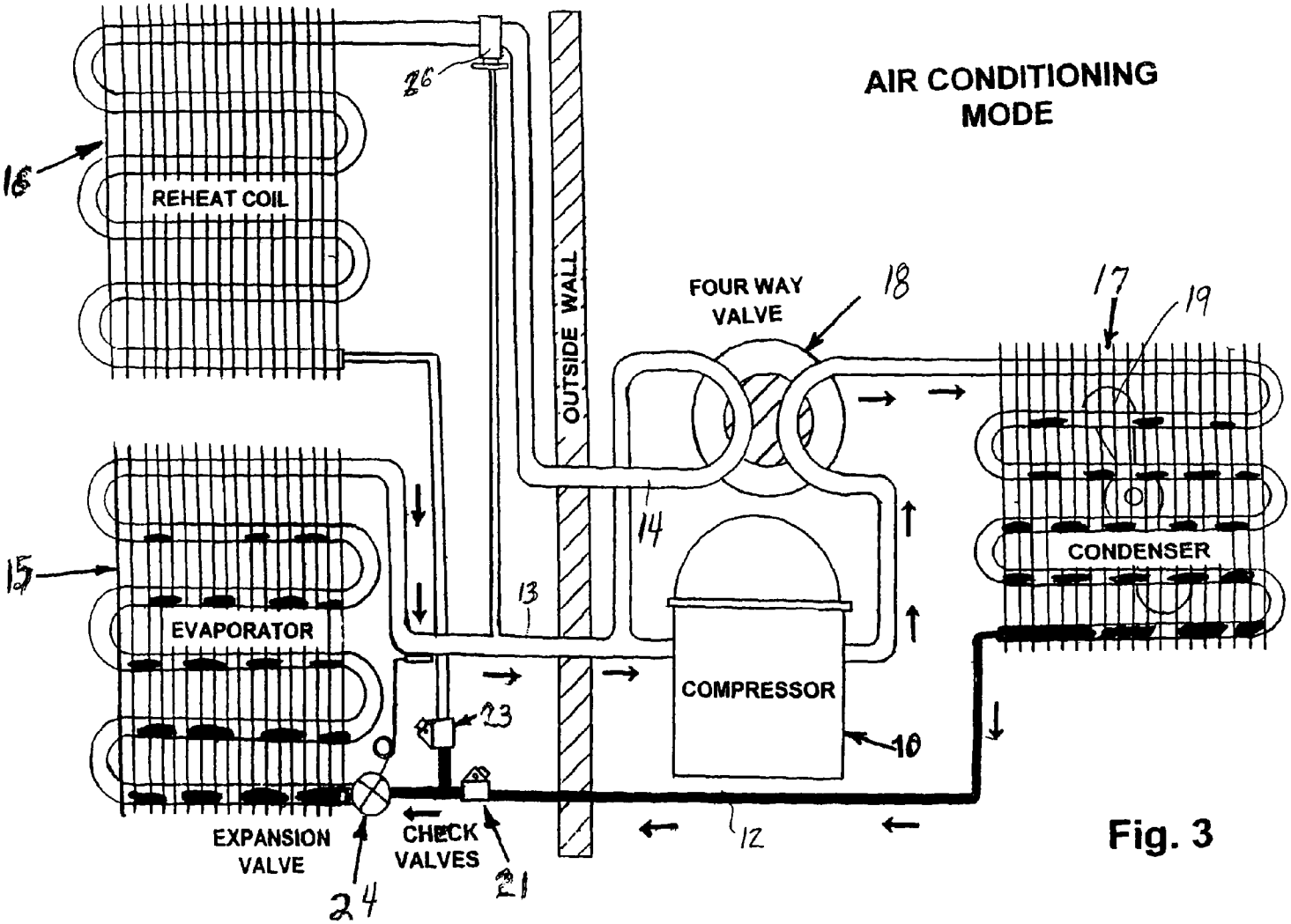
FIG. 3 is a schematic drawing of the environmental air control air conditioning system of the invention in the cooling mode of operation.

FIG. 3 Air Conditioning System. FIG. 3 is a schematic drawing of the environmental air control air conditioning system in the air conditioning mode of operation. The hot refrigerant gas leaves the discharge tube of the compressor 10 and passes through the four-way valve 18 into the condenser 17. The condenser fan 19 blows ambient air across the aluminum finned copper coil reducing the temperature of the refrigerant and it changes state from a hot gas to a warm liquid.

The liquid refrigerant passes through the copper tube 12, through the check valve 21 and into the inlet of the thermostatic expansion valve 24. The liquid refrigerant is prevented from flowing into the reheat coil by a check valve 23.

When the refrigerant leaves the thermostatic expansion valve 24 it enters the evaporator or cooling coil 15 which is an aluminum finned copper tube coil. The return air flowing through the coil to the furnace heats the refrigerant in the coil 15 evaporating the refrigerant to a cool gas. The air passing over the coil 15 is cooled and enters the fan in the furnace which distributes the cool air throughout the space to be conditioned. The cool refrigerant gas returns to the compressor 10 where it is compressed again into a hot gas to start the cycle over again.

The reheat coil 16, an aluminum finned copper tube coil that is approximately the same physical size and refrigerating capacity as the evaporator, has little or no refrigerant in it. This is because the refrigerant that was in the coil 15 has returned to the compressor 10. The air flowing across it has heated it to the same temperature as the air returning to the furnace and this temperature corresponds to a pressure above the suction pressure of the compressor thus it passes through the four-way valve 18 and back to the inlet side or suction side of the compressor 10. The outlet pressure regulator 26 is not active at this time as the pressure on both the inlet and outlet of the valve is equal.

Figure 4:
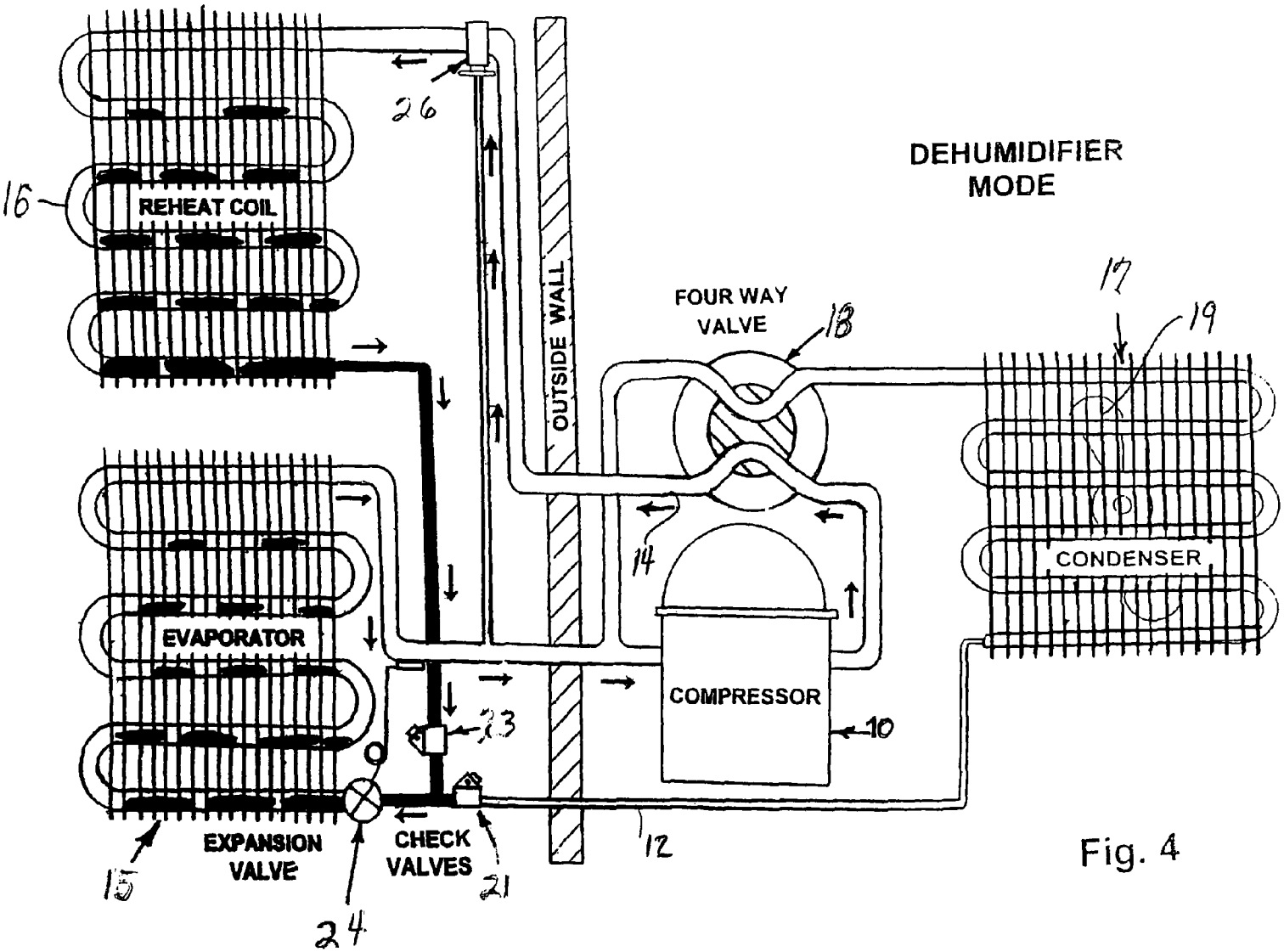
FIG. 4 is a schematic drawing of the environmental air control air conditioning system of the invention in the dehumidification mode of operation.

FIG. 4 Air Conditioning System. FIG. 4 is a schematic drawing of the environmental air control air conditioning system in the dehumidification mode of operation. The hot refrigerant gas leaves the discharge tube of the compressor 10 and enters the four-way valve 18. The four-way valve 18 has shifted so that now the refrigerant is directed to the reheat coil 16. The return air to the furnace cools the refrigerant in the reheat coil 16 condensing it from a hot gas to a warm liquid at the same time heating the air returning to the furnace.

The liquid refrigerant passes through the check valve 21 and enters the thermostatic expansion valve 24. The refrigerant is prevented from flowing into the copper liquid line and back to the condenser by a check valve 21.

The refrigerant leaves the thermostatic expansion valve 24 and enters the evaporator coil 15. It is heated by the return air to the furnace and evaporates changing from a warm liquid to a cool gas. It then returns to the inlet of the compressor 10 where it begins the cycle over again.

When the environmental air control air conditioning system is in the dehumidification mode of operation, the furnace or air handler fan motor speed is reduced. This causes a reduction in the cubic feet per minute of air that the fan moves and the temperature of the refrigerant in the evaporator is lowered. Ideally, the evaporator coil 15 should be at or below the dew point temperature of the air entering the evaporator. This speed reduction can be achieved by using a multiple speed motor. However, the best method is to use a variable speed motor controlled by a dew point sensor.

The outlet pressure regulator 26 is located in the hot gas discharge line going to the reheat coil 16. Valve 26 begins to open when the outlet pressure falls below a preset pressure. This is the pressure of the refrigerant in the evaporator coil 15 that corresponds to the evaporator temperature at which ice begins to form on the evaporator coil 15. As the valve 26 opens, the hot gas passes into the outlet of the evaporator coil 15. The pressure of the refrigerant rises in the evaporator coil 15 and also at the compressor 10 so ice does not form on the evaporator coil 15. This also adds more gas refrigerant returning to the compressor 10 and raises the inlet pressure in effect artificially loading the compressor 10. This prevents a condition termed "icing up" which ultimately leads to liquid refrigerant returning to the compressor 10 and premature compressor failure.

The evaporator coil 15 is placed in the return air and the air flowing over it is cooled. The reheat coil 16 is mounted in the return air stream after the evaporator coil 15 and warms the cooled dehumidified air back to the original return air temperature. A drop in the evaporator temperature due to reduced air flow will correspond to an increase in the temperature of the reheat coil 16. The result is little or no change in the return air temperature as it enters the furnace or air handler and ultimately enters the space that is being conditioned. There is no reduction in the temperature below the set point of the thermostat located in the space.

Figure 5:
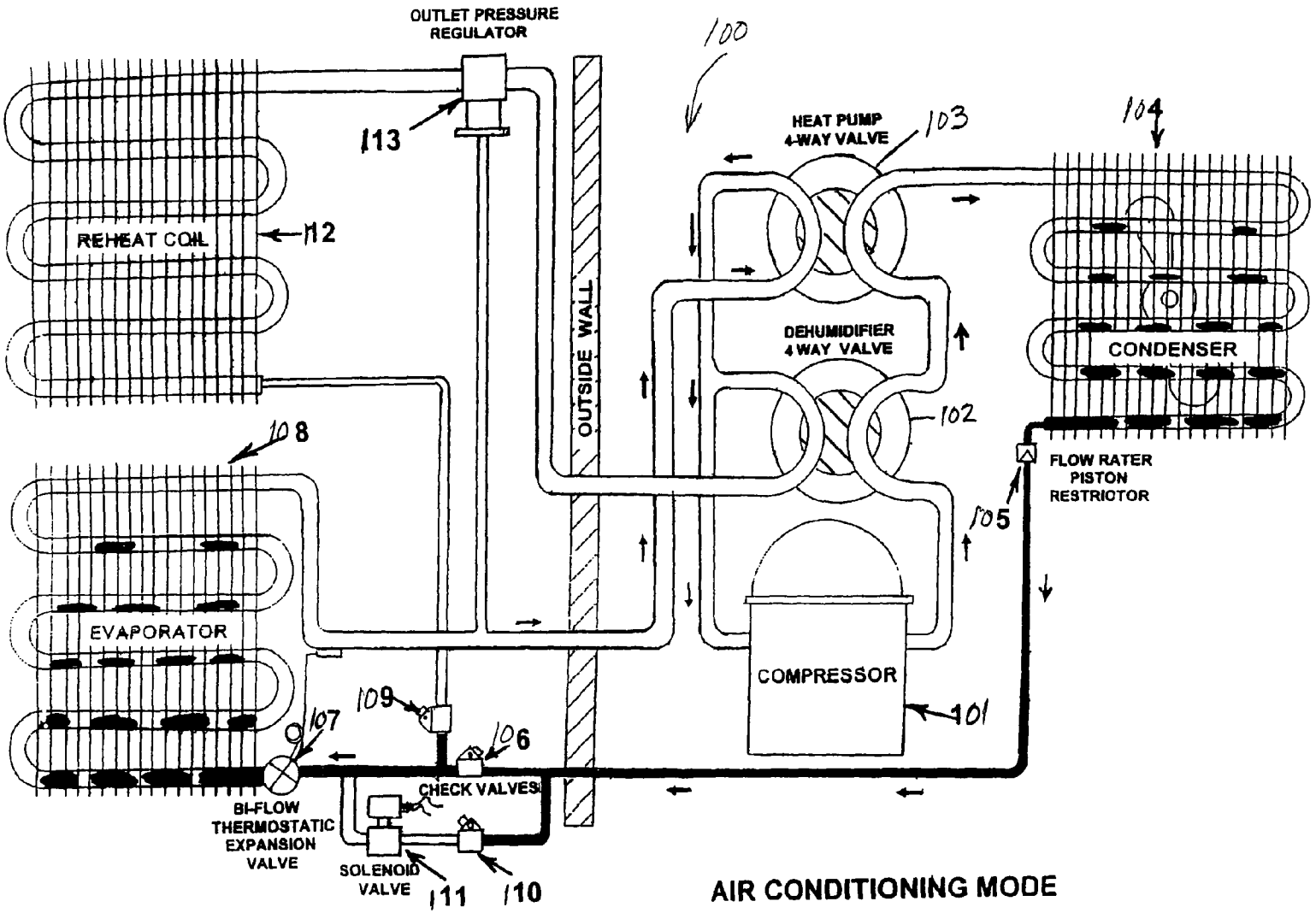
FIG. 5 is a schematic drawing of the environmental air control heat pump system of the invention in the air conditioning mode of operation.

FIG. 5 Heat Pump System. When the environmental air control heat pump system 100 is in the air conditioning mode, the hot gas from the discharge of the compressor 101 passes through the dehumidifier four-way valve 102, the heat pump four-way valve 103 and enters the condenser 104. The hot refrigerant gas is cooled and condenses to a warm liquid in the condenser 104 and passes through the flow rater piston restrictor 105 which is in the full open position. The warm liquid refrigerant passes through the check valve 106 and enters the bi-flow thermostatic expansion valve 107. The liquid refrigerant enters the evaporator coil 108 where it is heated by the return air to the furnace and changes to a cool gas while cooling the return air passing over the coil to the furnace. The cool gas goes through the heat pump four-way valve 103, the dehumidifier four-way valve 102, and returns to the inlet or suction side of the compressor to start the cycle over again.

The liquid refrigerant is prevent from entering the outlet of the solenoid valve 111 by a check valve 110 and the liquid refrigerant does not enter the reheat coil 112 because of a check valve 109. The outlet pressure regulator 113 is closed because the pressure on the inlet of the valve is the same as the outlet of the valve. Any refrigerant in the reheat coil 112 has evaporated and returned to the inlet of the compressor because the air flowing over the reheat coil has raised the temperature and pressure above the cool gas returning from the evaporator coil 108.

Figure 6:
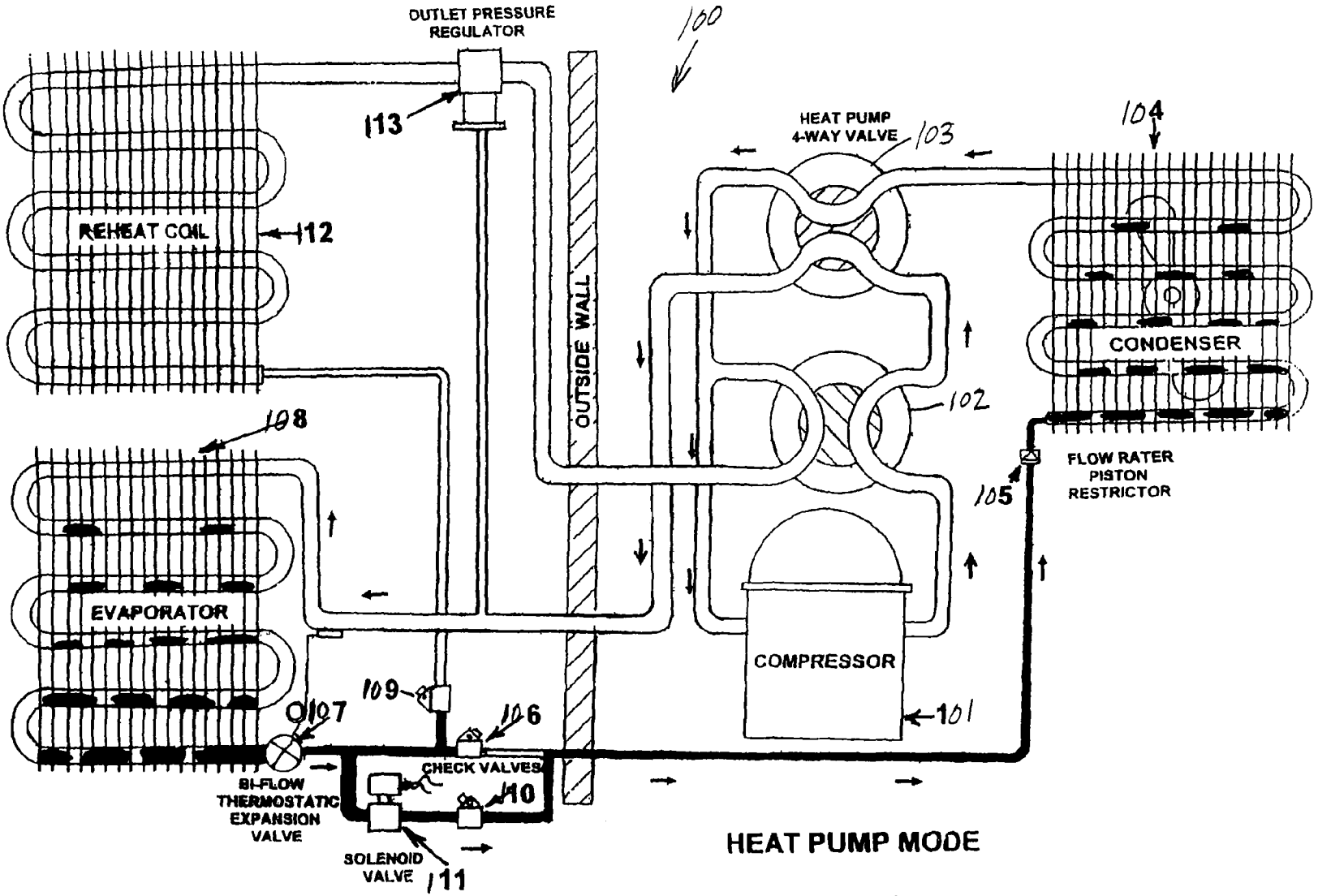
FIG. 6 is a schematic drawing of the environmental air control heat pump system of the invention in the heat pump mode of operation.

FIG. 6 Heat Pump System. During the operation of the environmental air control heat pump system in the heat pump mode, the hot gas from the compressor 101 passes through the dehumidifier four-way valve 102 and enters the heat pump four-way valve 103. The heat pump four-way valve 103 has shifted from the air conditioning mode and now directs the hot gas leaving the compressor 101 to the outlet of the evaporator coil 108. As the hot refrigerant gas passes through the evaporator coil 108 it changes from a hot gas to a warm liquid before entering the bi-flow thermostatic expansion valve 107. The bi-flow thermostatic expansion valve 107 is designed specifically for heat pump applications and restricts the flow of refrigerant to the evaporator coil 108 during the cooling mode of operation but allows the full flow through an internal check valve during the heating mode of operation.

The warm liquid refrigerant goes through the now open solenoid valve 111, check valve 110 and through the liquid line to the flow rater piston restrictor 105. The flow rater piston restrictor 105 has shifted due to the reversed pressure differential across the valve, and now meters the flow refrigerant into the condenser 104 through a small orifice in the piston of the valve. The warm liquid changes into a cool gas as it passes through the condenser 104 cooling the outside air passing over the condenser coil. The cool gas goes through the heat pump four-way valve 103 and returns to the inlet or suction side of the compressor 101 to begin the cycle over again.

In the heating mode, the liquid refrigerant is prevent from entering the reheat coil 112 by a check valve 109. Any refrigerant in the reheat coil 112 has changed to a gas and has passed through the reheat four-way valve 102 to the inlet of the compressor 101. Any refrigerant remaining in the reheat coil 112 has been heated by the return air going to the furnace and warmed to a gas. This refrigerant gas returning to the compressor has a higher pressure than the cool gas returning to the compressor 101 from the condenser 104. The outlet pressure regulator 113 is closed because the pressure is the same on both the inlet and outlet of the valve.

Figure 7:
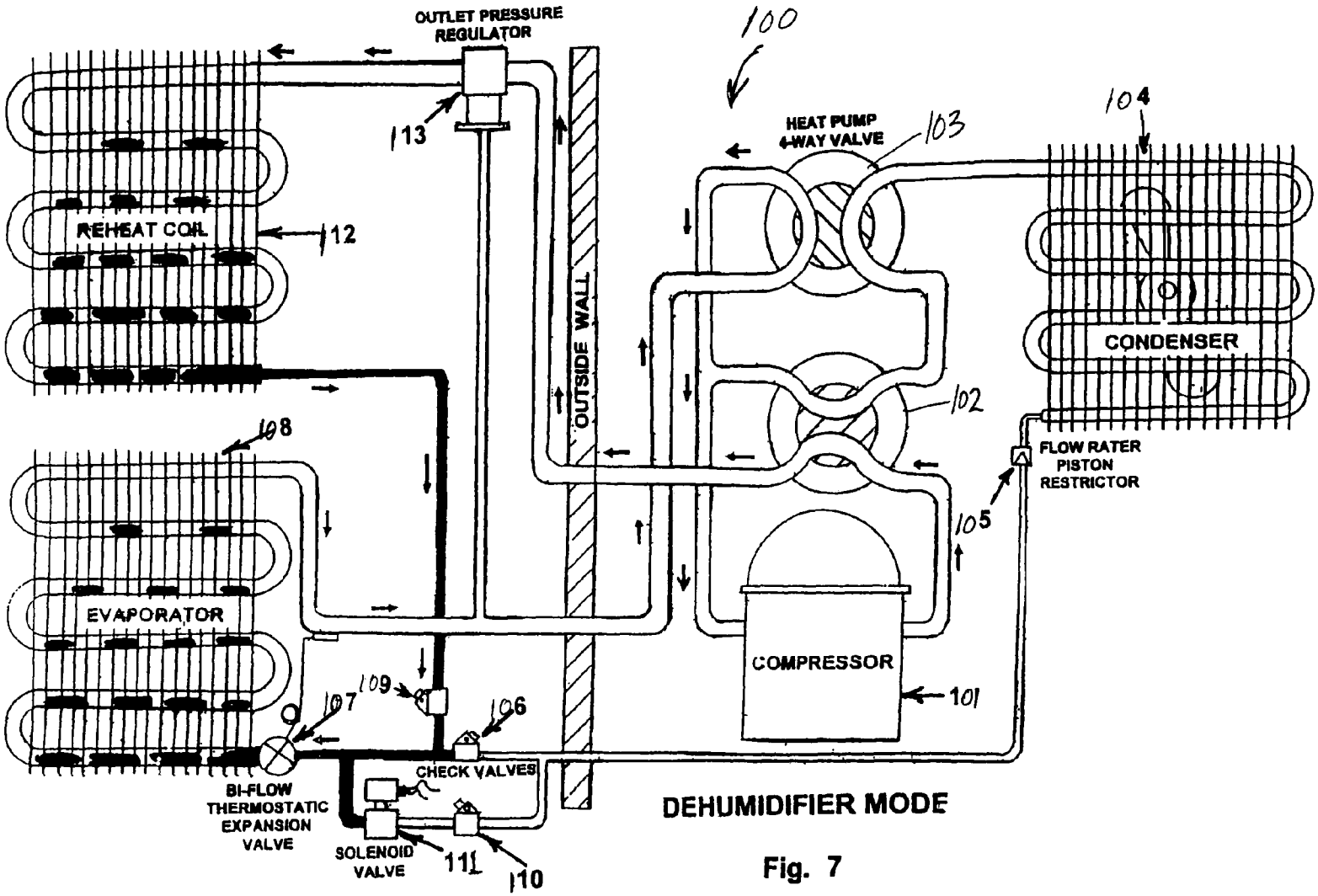
FIG. 7 is a schematic drawing of the environmental air control heat pump system of the invention in the dehumidifier mode of operation.

FIG. 7 Heat Pump System. When the environmental air control heat pump system is in the dehumidifier mode, the hot discharge refrigerant gas from the compressor passes through the dehumidifier four-way valve 102 which has shifted from the normal position and enters the reheat coil 112. In the reheat coil it changes from a hot gas to a warm liquid because it is cooled by the return air going to the furnace.

The warm liquid goes through the check valve 109 and into the bi-flow thermostatic expansion valve 107 and into the evaporator coil 108. In the evaporator coil 108 it changes from a warm liquid to a cool gas as it is heated by the air returning to the furnace or air handler. The air passing over the evaporator coil 108 is cooled as it returns to the furnace or air handler.

The cool gas leaving the evaporator coil 108 passes through the suction tube to the heat pump four-way valve 103 and into the inlet or suction side of the compressor 101 where it begins the cycle again.

The outlet pressure regulator valve 113 is located in the hot gas line going to the reheat coil 112. The valve 113 is adjusted so that the outlet pressure of the valve 113 will maintain a minimum pressure, and thus the temperature in the evaporator. This prevents the moisture in the air passing over the evaporator from condensing and then freezing on the evaporator surfaces. This condition is called "icing up" and can stop the air flow or cause damage to the compressor.

When the environmental air control heat pump system is in the dehumidification mode of operation, the fan motor runs at a slower speed. The reduction in speed results in less cubic feet per minute of air being moved across the coil and this causes a drop in the pressure and temperature of the refrigerant in the evaporator. The lower temperature results in more water being removed from the air. This can be accomplished by using a multi speed motor with four or less speed settings, but to maximize the dehumidification capabilities of the system a variable speed motor controlled by a dew point sensor should be used.

In the dehumidifier mode, the evaporator's ability to cool the air is balanced by the reheat coil's ability to heat the air and thus there is little or no change in the temperature of the air returning to the furnace or air handler.

A humidifier, while not shown in any of the drawings, can be added to either the air conditioning or heat pump systems. This would allow the owner/operator to increase the humidity level of the space when necessary, particularly the colder months of the year. There would need to be a dead band in the humidistat section of the control circuit plus a lock out to prevent the operation of both the humidifier and the dehumidifier at the same time. In conjunction with this control, it is recommended that when the system is shifted from one mode to another, a time delay be initiated to stabilize the refrigerant condition and insure stable operation of the system. Also, it is advisable to use an accumulator on both the air conditioning and heat pump systems to prevent the return of liquid refrigerant to the compressor.

The invention claimed is:

1. An air control apparatus for an enclosed environment comprising: a refrigerant compressor having a refrigerant inlet and outlet, a condenser, an evaporator coil, a reheat coil, a first tube for carrying liquid refrigerant from the condenser to the evaporator coil, an expansion valve in communication with said first tube adjacent the evaporator coil, a first check valve connected to the first tube between the condenser and the expansion valve for allowing the flow of liquid refrigerant from the condenser to the expansion valve and preventing the flow of liquid refrigerant from the expansion valve back to the condenser, a second tube for carrying liquid refrigerant from the reheat coil to the first tube between the expansion valve and first check valve, a second check valve connected to the second tube for allowing liquid refrigerant to flow from the reheat coil to the expansion valve and preventing liquid refrigerant from flowing from the expansion valve and first check valve back to the reheat coil, a four way valve in communication with said condenser, evaporator coil, reheat coil and inlet and outlet of the compressor, a third tube connecting the reheat coil with the four way valve, and an outlet pressure regulator connected to the third tube operable to open when the outlet pressure of the refrigerant falls below a preset pressure to inhibit formation of ice on the evaporator coil, said four way valve being selectively operable to connect the outlet of the compressor to the condenser and the inlet of the compressor to the evaporator coil and the reheat coil and to connect the outlet of the compressor to the reheat coil and the inlet of the compressor to the evaporator coil and condenser to control the temperature and humidity of the enclosed environment.

2. The air control apparatus of claim 1 wherein: the expansion valve is a thermostatic expansion valve.

3. An air control apparatus comprising: a furnace for heating air having an air return inlet, an evaporator coil and reheat coil located in the air return inlet, a condenser, a refrigerant compressor having a refrigerant inlet and outlet, a first tube for carrying liquid refrigerant from the condenser to the evaporator coil, an expansion valve in communication with said first tube adjacent the evaporator coil, a first check valve connected to the first tube between the condenser and the expansion valve for allowing the flow of liquid refrigerant from the condenser to the expansion valve and preventing the flow of liquid refrigerant from the expansion valve back to the condenser, a second tube for carrying liquid refrigerant from the reheat coil to the first tube between the expansion valve and first check valve, a second check valve connected to the second tube for allowing liquid refrigerant to flow from the reheat coil to the expansion valve and preventing liquid refrigerant from flowing from the expansion valve and first check valve back to the reheat coil, a four way valve connecting the compressor with the condenser and evaporator coil and reheat coil, a third tube connecting the reheat coil with the four way valve, and an outlet pressure regulator connected to the third tube operable to open when the outlet pressure of the refrigerant falls below a preset pressure to inhibit formation of ice on the evaporator coil, said four way valve being selectively operable to connect the outlet of the compressor to the condenser and the inlet of the compressor to the evaporator coil and the reheat coil and to connect the outlet of the compressor to the reheat coil and the inlet of the compressor to the evaporator coil and condenser to control the temperature and humidity of air and provide a dehumidification mode while the furnace is heating air to allow the humidity of the air to be reduced while heat is required and retaining the humidity level above a desired level.

4. The air control apparatus of claim 3 wherein: the expansion valve is a thermostatic expansion valve.

* * * * *